US005280292A

United States Patent [19]

Tondryk

[11] Patent Number: 5,280,292

[45] Date of Patent: Jan. 18, 1994

[54] MULTI-PORT MICROWAVE COUPLER UTILIZED IN A BEAM FORMING NETWORK

[75] Inventor: Wieslaw J. Tondryk, London, United Kingdom

[73] Assignee: Matra Marconi Space UK Limited, Stanmore, United Kingdom

[21] Appl. No.: 910,890

[22] Filed: Jul. 10, 1992

[30] Foreign Application Priority Data

Jul. 18, 1991 [GB] United Kingdom ..... 9115580

[51] Int. Cl.[5] ..... H01Q 3/22; H01Q 3/24; H01Q 3/26; H01P 5/18

[52] U.S. Cl. ..... 342/373; 333/109; 333/116

[58] Field of Search ..... 333/109, 113-116; 342/373

[56] References Cited

U.S. PATENT DOCUMENTS

| | | | |
|---|---|---|---|
| 3,295,134 | 12/1966 | Lowe | 333/109 X |
| 3,480,885 | 11/1969 | Schrenk | 333/109 X |
| 4,356,461 | 10/1982 | Acoraci | 333/116 |
| 4,633,259 | 12/1986 | Hrycak | 342/373 |

FOREIGN PATENT DOCUMENTS

| | | |
|---|---|---|
| 2651939 | 3/1991 | France . |
| 1226997 | 3/1971 | United Kingdom . |
| 2158649 | 11/1985 | United Kingdom . |

OTHER PUBLICATIONS

IRE Transactions on Antennas and Propagation, vol. 9, Mar. 1961, "Multiple Beams For Linear Arrays", J. P. Shelton et al.

Frequenz, vol. 24, No. 12, Dec., 1970, "A General Synthesis Procedure For Beam-Forming Matrices", J. F. Gobert, pp. 364-367.

IEE Proceedings, Part H, vol. 137, No. 5, Oct., 1990, "Review of Radio Frequency Beamforming Techniques for Scanned and Multiple Beam Antennas", P. S. Hall et al., pp. 293-303.

*Primary Examiner*—Paul Gensler

*Attorney, Agent, or Firm*—Spencer, Frank & Schneider

[57] ABSTRACT

A multi-port microwave coupler has six input ports In 1, In 2, In 3, In 4, In 5 and In 6 and six output ports Out 1, Out 2, Out 3, Out 4, Out 5 and Out 6 and is synthesized from nine 2×2 90° hybrid couplers which are arranged as three sets, that is a first set A, B and C, a second set D, E and F and a third set G, H and I. A first group of transmission lines interconnect the first and second sets of hybrid couplers, and a second group of transmission lines interconnect the second and third sets of hybrid couplers The first and third sets of couplers each give a 3 dB power reduction, but the second set give a 1:2 power split between their outputs. Three 90° phase shift, devices X, Y and Z correct the phase of the signals in three of the transmission lines of the second group. When equal amplitude signals are applied to all of the input ports, the combined signal can be directed to any one of the output ports by appropriately selecting the respective phases of the input signals. The first and second groups of transmission lines can be arranged as respective transmission rings so that all cross-overs in the transmission lines are avoided thereby providing a planar realization of a 6×6 multi-port microwave coupler. The invention is of application to higher order n×n multi-port microwave couplers where $n=2^p\times 2^q$ with both p and q as whole numbers.

8 Claims, 5 Drawing Sheets

MULTI-PORT MICROWAVE COUPLER UTILIZED IN A BEAM FORMING NETWORK

BACKGROUND OF THE INVENTION

This invention relates to a multi-port microwave coupler particularly, but not exclusively, to be used as a part of a beam-forming network for a multi-beam antenna carried by a satellite.

Such multi-port microwave couplers are well-known in the art of microwave frequency transmission and typically comprise a hybrid coupler having four ports, that is two input ports and two output ports. Such hybrid couplers are commonly referred to as 2×2 hybrid couplers and have the following characteristics:

1. When a microwave signal is applied to one of the input ports, the complex voltages appearing at both output ports are equal in amplitude, and no power appears at the other input port.

2. When equal-amplitude microwave signals are applied to both of the input ports, all of the power can be made to appear at only one of the output ports by appropriately selecting the relative phases of the two input signals.

However there is a requirement for higher-order couplers in certain applications, for example in beam-forming networks and multiple matrix amplifiers for multi-beam antennas. Such higher-order couplers have equal numbers of input ports and output ports, and a coupler with 2n ports is commonly referred to as a n×n coupler. In the case where the hybrid order n is a power of 2, such higher-order couplers can be synthesized from combinations of 2×2 hybrid couplers interconnected by transmission lines.

In synthesizing higher-order couplers from 2×2 hybrid couplers, the transmission lines interconnecting the 2×2 hybrid couplers essentially cross one another. With the simplest higher-order coupler, the hybrid order n is the second power of 2 and only four 2×2 hybrid couplers are necessary to provide a 4×4 coupler. This arrangement only incurs one "cross-over" between the transmission lines and it is known to rearrange the positions of the four 2×2 hybrid couplers to avoid this single "cross-over".

Multi-port couplers of even higher orders can be synthesized from 2×2 hybrid couplers to give an n×n coupler where $n=2^{(2+p)}$ and p is a whole number. Thus, when p=1 an 8×8 coupler can be achieved, when p=2 a 16×16 coupler, when p=3 a 32×32 coupler, and so on. Existing 8×8 couplers involve many cross-overs with the result that the transmission lines become a complex multi-layer strucrure.

Such cross-overs in the transmission lines may be implemented in various ways. For example, in stripline, microstrip and similar realizations, the 2×2 hybrid couplers can be fitted with connectors and external semi-rigid cables can be used for the transmission lines. In microstrip realizations, bridges of wire, foil or cable can be used. In "square-ax" realizations, bridging devices can be used. In waveguide realizations, combinations of waveguide bends can be used. Also multi-layer microstrip or stripline devices could be designed.

In all of the above realizations, the requirement for cross-overs incurs penalties in the mass, size and complexity of any synthesized multi-port coupler in which $n=2^{(2+p)}$, and such penalties are problematic in satellite applications where lightness, smallness and simplicity are important.

It is an object of the present invention to provide a multi-port microwave coupler where $n=2^p\times 3^q$ with p and q as whole numbers. The simplest hybrid coupler of this definition is a 6×6 coupler which is achieved when p=1 and q=1. It is an ancillary object of this invention to minimize the number of cross-overs in such multi-port microwave couplers.

SUMMARY OF THE INVENTION

According to one aspect of the invention, a multi-port microwave coupler having n input ports and n output ports, wherein $n=2^p\times 3^q$ with p and q as whole numbers, comprises a plurality of hybrid couplers, each having two inputs and two outputs said hybrid couplers being arranged in three sets, the first set comprising n/2 90° hybrid 2×2 hybrid couplers each having a 3 dB power reduction, the second set comprising n/2 90° hybrid 2×2 couplers each having a 1:2 or a 2:1 power split between their outputs, the third set comprising n/2 90° or 180° hybrid couplers, a first group of transmission lines interconnecting the outputs of the first set appropriately with the inputs of the second set, a second group of transmission lines interconnecting the outputs of the second set appropriately with the inputs of the third set, and phase shift means appropriately positioned in the second group of transmission lines.

Preferably the first hybrid coupler of the first set has its outputs respectively connected to inputs of the first and second hybrid couplers of the second set, the second hybrid coupler of the first set has its outputs respectively connected to inputs of the first and third hybrid couplers of the second set, the first hybrid coupler of the second set has one output connected through a 90° phase shift (constituting part of said phase shift means) to one input of the first hybrid coupler of the third set and its other output connected to an input of the second hybrid coupler of the third set, the second hybrid coupler of the second set has one output connected to the other input of the first hybrid coupler of the third set and its other output connected through a 90° phase shift (also constituting part of said phase shift means) to one input of the third hybrid coupler of the third set, and the remaining hybrid couplers are interconnected appropriately in similar manner. In this case the last hybrid coupler of the first set may have its outputs respectively connected to inputs of the last and second hybrid couplers of the second set, and the last hybrid coupler of the second set has one of its outputs connected to an input of the last hybrid coupler of the third set and its other output connected through a 90° phase shift (also constituting part of said shift means) to an input of the second hybrid coupler of the third set.

In the case of a 6×6 microwave coupler, both p and q would of course be 1 and there would be only three 2×2 hybrid couplers in each set with the outputs of the third set defining the output ports. In this case the hybrid couplers may be arranged such that there are no cross-over connections in the first or second groups of transmission lines. In this manner the first and second groups of transmission lines may be arranged to lie in the same plane.

According to another aspect of the invention the first and second groups of transmission lines may respectively comprise first and second transmission rings, the second set of hybrid couplers is arranged between the transmission rings with their inputs connected to the first transmission ring and their outputs connected to the second transmission ring. In this case the first set of hybrid couplers is preferably positioned on the opposite side of the first transmission ring to the second set of hybrid couplers and has its outputs connected to the first transmission ring, and the third set of hybrid couplers is positioned on the opposite side of the second transmission ring to the second set of hybrid couplers and has its inputs connected to the second transmission ring. Preferably the first and second transmission rings lie in the same plane.

In addition to the provision of a multi-port microwave coupler, the invention also extends to a beamforming network for a multi-beam antenna incorporating such multi-port microwave coupler.

BRIEF DESCRIPTION OF THE DRAWINGS

The invention will now be described, by way of example only, with reference to the accompanying drawings, in which.

DESCRIPTION OF THE PREFERRED EMBODIMENTS

Figure 1:
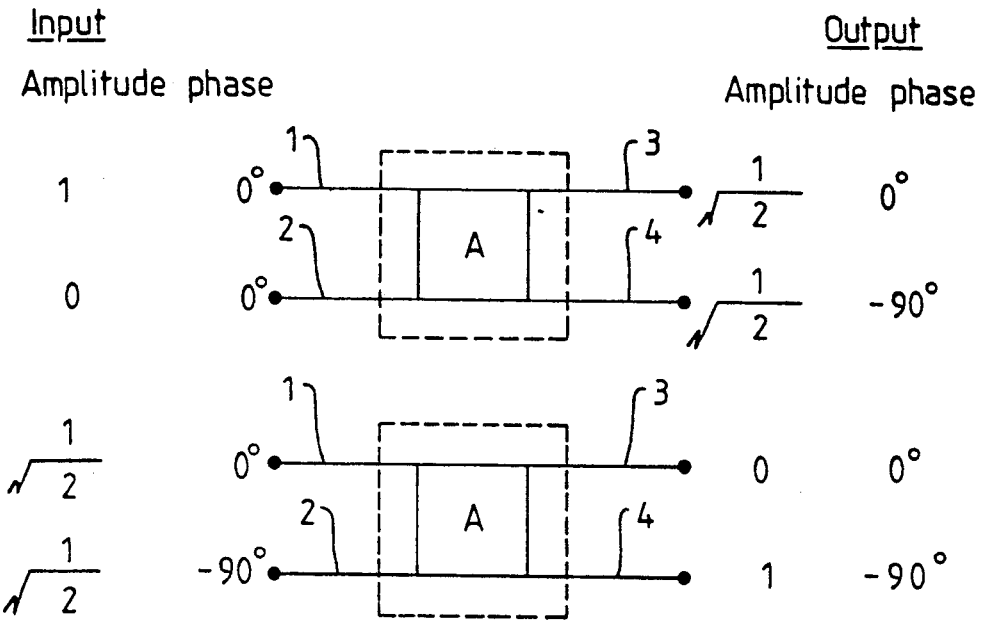
FIG. 1 PRIOR ART
FIG. 1 is a diagram of a known 2×2 3 db hybrid coupler illustrating its operation.

With reference to FIG. 1, a 2×2 3 db hybrid coupler A is shown in each of its two operative modes. In the upper part of this figure, a microwave signal applied to input port 1 produces signals in phase quadrature at the output ports 3 and 4, but with no power appearing at the other input port 2. In the lower part of this figure, equal microwave signals applied to the input ports 1 and 2, but with a 90° phase separation, cause the resultant signals to cancel each other out at output port 3, whilst the signals combine at outport 4.

Figure 2:
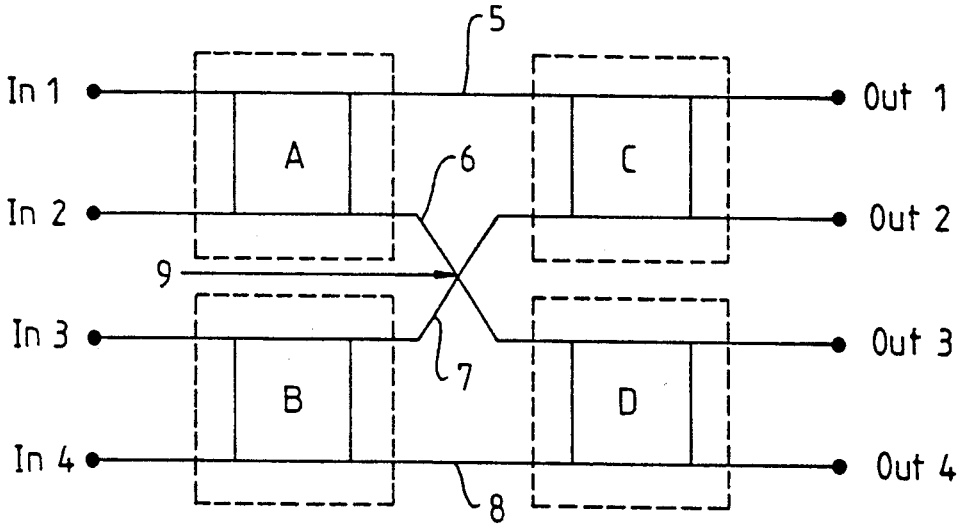
FIG. 2 PRIOR ART
FIG. 2 is a diagram of a known 4×4 coupler synthesized from four 2×2 hybrid couplers.

In FIG. 2, four 2×2 3 db hybrid couplers A, B, C and D have been synthesized in known manner to provide a 4×4 multi-port coupler having four input ports, In 1, In 2, In 3 and In 4 and four outputs Out 1, Out 2, Out 3 and Out 4. It will be noted that the hybrid coupler A is connected by transmission lines 5 and 6 respectively to the one inlets of hybrid couplers C and D, whilst the hybrid coupler B is connected by transmission lines 7 and 8 to the other inlets of hybrid couplers C and D. As a consequence the transmission lines 6 and 7 "cross-over" as indicated by arrow 9.

Figure 3:
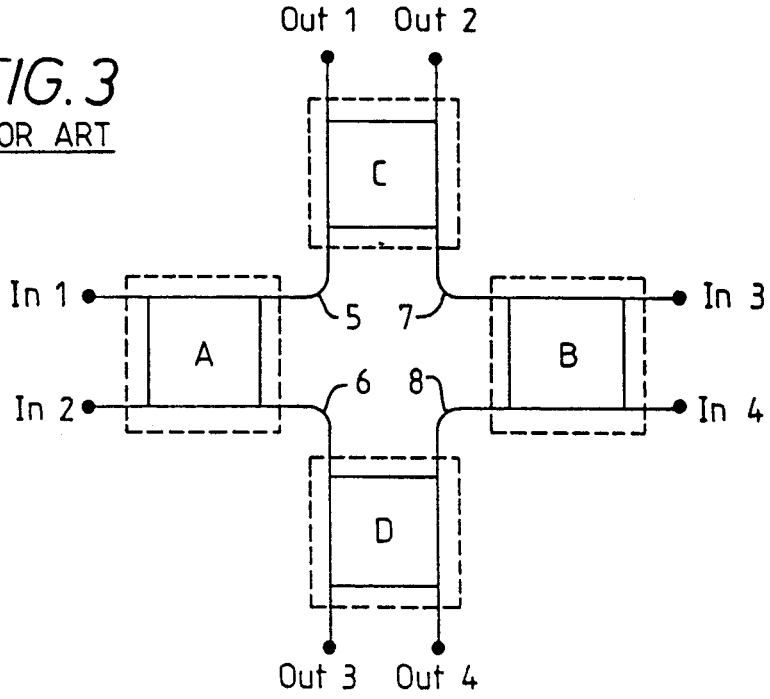
FIG. 3 PRIOR ART
FIG. 3 illustrates a known reorganization of the 4×4 coupler illustrated in FIG. 2.

FIG. 3 illustrates a known manner of reorganizing the hybrid couplers A, B, C and D of FIG. 2 so that their transmission lines 5, 6, 7 and 8 do not cross-over each other. This enables the transmission lines 5, 6, 7 and 8 to be arranged in the same plane and gives a truly planar implementation of a 4×4 hybrid coupler. This planar realization has the following advantages:

1. Lower insertion loss from input to output ports because features, such as connectors, cables, bridges, etc. all of which would add to the basic loss of the device, are avoided.
2. Better return loss and isolation because reflections caused by connectors, bridges, and other discontinuities are absent.
3. Reduced size because the height is limited to that of the basic planar transmission line structure, and the extra length often required to accommodate cross-overs is avoided.
4. Lower mass as a result of the smaller size.
5. Better reproducibility between examples of the device is possible, either as simple printed or machined structures, without any need for hand-made interconnections.
6. Lower cost and higher reliability because the structure is simpler, and the extra parts and connections required for cross-overs are avoided
7. Less likelihood of passive intermodulation product generation and multipaction breakdown because internal discontinuities are avoided This is particularly important in a high power, multi-carrier application.
8. Better amplitude and phase balance and tracking between output ports, as the electrical lengths within the network are better controlled.

All of these eight advantages are of primary importance in satellite applications.

Figure 4:
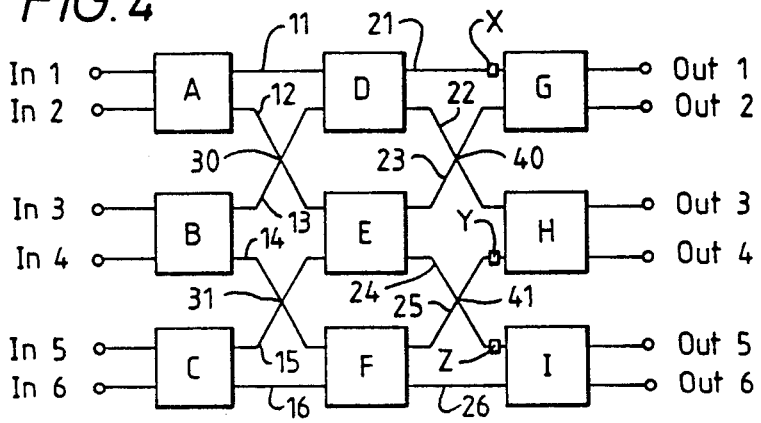
FIG. 4 is a diagram illustrating how a 6×6 coupler can be synthesized from nine 2×2 hybrid couplers.

Hitherto it has been considered that n×n multi-port microwave couplers could not be synthesized from 2×2 hybrid couplers where n is a power of 3. FIG. 4 illustrates the synthesis of a 6×6 multi port microwave coupler from nine 2×2 hybrid couplers A, B, C, D, E, F, G, H and I, and from three phase shift devices X, Y and Z. A 6×6 microwave coupler is an n×n coupler wherein $n=2^p\times 3^q$ with p and q both being equal to 1 and is, therefore, the simplest microwave coupler of this type. When p=2 and q= 1 a 12×12 coupler can be achieved, when p=1 whilst q=2 an 18×18 coupler, when p=3 and q=1 a 24×24 coupler is achieved, and so on.

From FIG. 4 it will be noted that the nine 2×2 hybrid couplers are arranged in three sets of three, the first set A, B, C defining the six inlet ports In 1, In 2, In 3, In 4, In 5 and In 6 whilst the third set G, H and I defines the six outlet ports Out 1, Out 2, Out 3, Out 4, Out 5 and Out 6. The couplers A, B, C, G, H and I are all 90° hybrids, of the type described with reference to FIG. 1, each giving a 3 db power reduction so that an input signal applied to one port will result in equal amplitude quadrature-phased outputs. Whilst the three couplers D, E and F are also 90° hybrids, they are of the form shown in FIG. 5 to provide a 1:2 power split between their outputs 21 and 22. That is, each of the couplers D, E and F has the property that, when a signal is applied to one inlet port, one third of the power will appear at one outlet port, two thirds of the power will appear at the second outlet port with the output signals in phase quadrature, but with the second inlet port being isolated. On the other hand, if quadrature phase signals with power levels in the ratio 2:1 are applied to the inlet ports, then all of the power will appear at one outport whilst the second output port will be isolated. The first set of hybrid couplers A, B and C are connected to the second set of hybrid couplers D, E and F by a first group of transmission lines 11, 12, 13, 14, 15 and 16, whilst the second set of hybrid couplers D, E and F are connected to the third set of hybrid couplers G, H and I by a second group of transmission lines 21, 22, 23, 24, 25 and 26, the phase shift device X being positioned in transmission line 21, the phase shift device Y being positioned in the transmission line 25, and the phase shift device Z being positioned in the transmission line 24.

Figure 5:
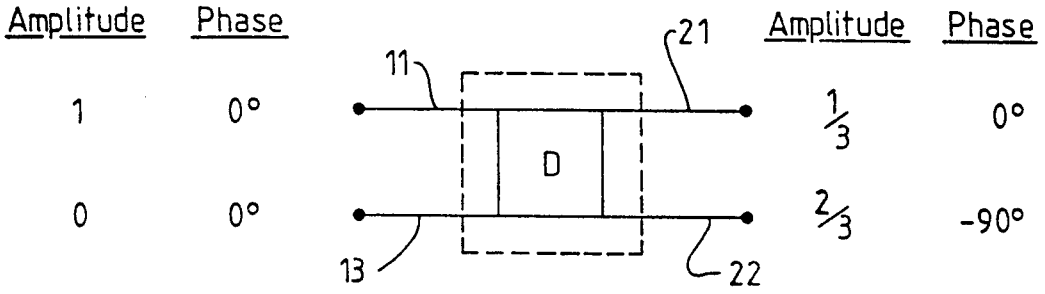
FIG. 5 is a diagram illustrating the operation of a 2×2 90° hybrid coupler providing a 1:2 power split between its outputs.
Figure 6:
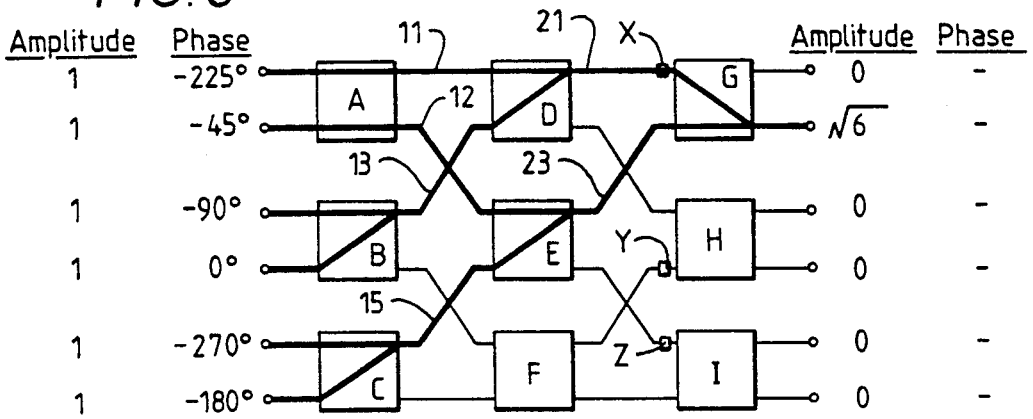
FIGS. 6 and 7 illustrate the operation of the 6×6 coupler of FIG. 4.

FIG. 6 illustrates the operation of the 6×6 hybrid coupler just described with reference to FIGS. 4 and 5. The darker lines in FIG. 6 show the signal flow when signals of equal amplitude are applied to the input ports with relative phase shifts, as shown, produced by a beam forming network. It will be noted that signals are applied in quadrature to couplers B and C so that power combination takes place in transmission lines 13 and 15 so that the signal power in each case is twice that applied to any one of the input ports. However, the signals applied to hybrid coupler A are in anti-phase whereby equal powers will appear in transmission lines 11 and 12. The power inputs to the hybrid coupler D through transmission lines 11 and 13 are in the ratio 2:1, and have the required relative phase to produce signal combination in transmission line 21. Exactly the same conditions apply to hybrid coupler E so that all of the power applied through transmission lines 12 and 15 will appear in transmission line 23. The equal signals applied through transmission lines 21 and 23 are correctly phased by the 90° phase shift device X to produce a combined signal at Out 2 as shown. It will be noted that the hybrid couplers F, H and I are completely isolated as none of the signals are applied to the respective inward transmission lines 14 and 16, 22 and 25, or 24 and 26.

Although FIG. 6 illustrates how signals applied to all six input ports can be directed to a single output port Out 2 whilst all other outputs are isolated, it should be noted that other input signal phase combinations can be selected so that the combined signal will appear at any one of the output ports Out 1, Out 2, Out 3, Out 4, Out 5 or Out 6 whilst all the other output ports remain isolated. In this manner the matrix illustrated in FIGS. 4 to 6 can be used in a beam forming network for a multibeam antenna whereby appropriate selection of the input phase combinations will produce a specific antenna beam.

Figure 7:
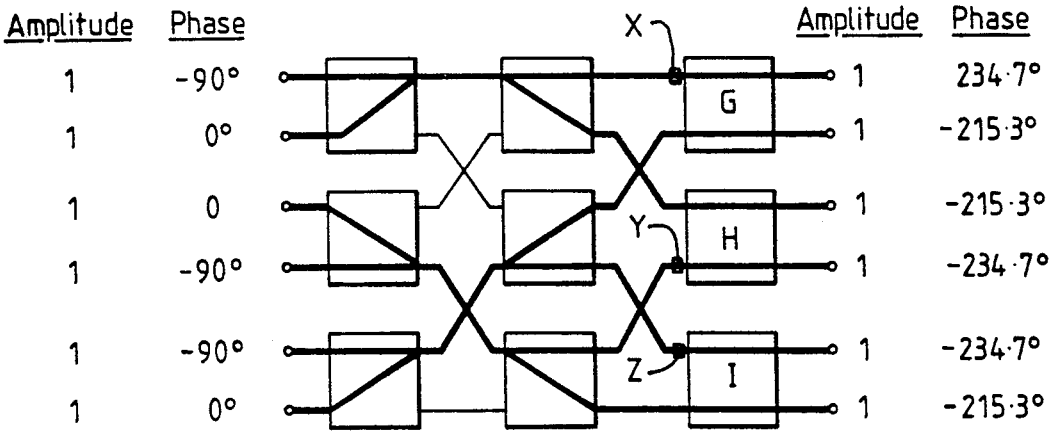

The darker lines in FIG. 7 illustrate how correctly phased equal amplitude input signals can result in the generation of equal amplitude signals at each of the outlet ports. This feature is necessary in some antenna beam-forming applications.

Figure 8:
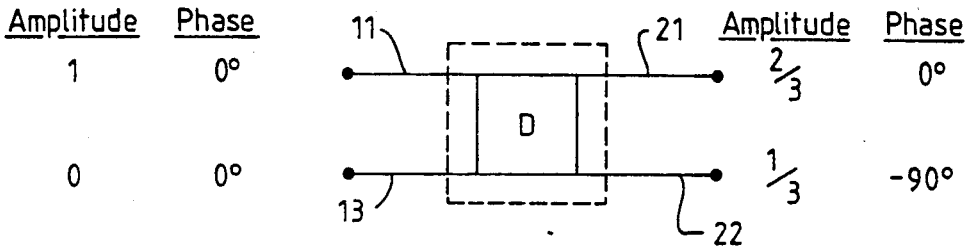
FIG. 8 is a diagram illustrating the operation of a 2×2 90° hybrid coupler providing a 2:1 power split between its output ports.

Whilst the 6×6 configuration taught by FIGS. 4 to 7 utilizes three of the hybrid couplers described with reference to FIG. 5 for the second layer of couplers D, E and F to provide a 1:2 power split between their respective outputs 21 and 22, 23 and 24, and 25 and 26, it is possible to form an alternative 6×6 configuration utilizing hybrid couplers with a 2:1 power shift for the second layer of couplers D, E and F. FIG. 8 illustrates this alternative form of hybrid coupler and it will be noted that this configuration is the same as that illustrated in FIG. 5 with the exception that the value of the power outputs 21 and 22 are reversed to give a 2:1 power shift.

Figure 9:
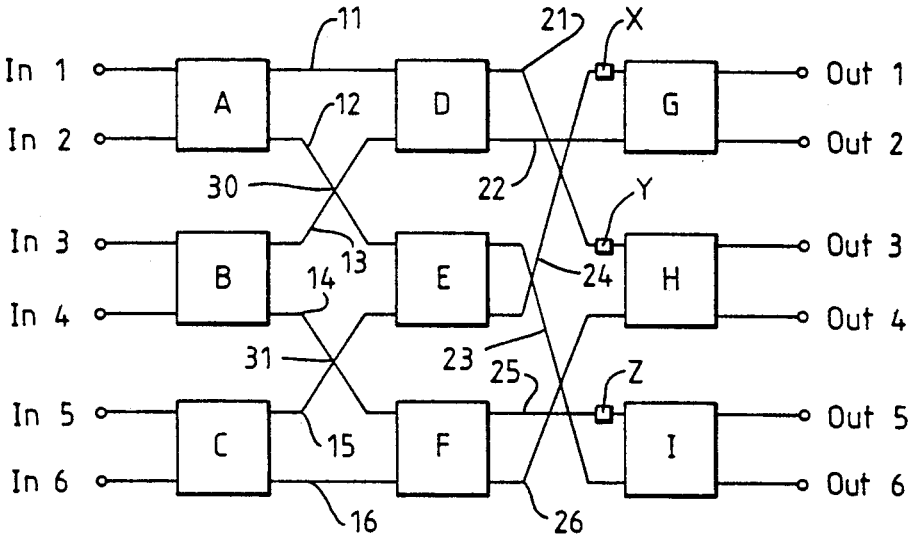
FIG. 9 is a diagram, similar to FIG. 4, but illustrating another manner of synthesizing a 6×6 coupler from nine 2×2 hybrid couplers.

As FIG. 9 is generally similar to FIG. 4, the same reference numerals have been utilized to denote equivalent features and only the points of difference will now be described. The second layer of hybrid couplers D, E and F are of the form just described with reference to FIG. 8, the second group of transmission lines 21, 22, 23, 24, 25 and 26 are connected in a different sequence to the third layer of hybrid couplers G, H, and I, and the phase shift devices X, Y and Z are repositioned respectively into lines 24, 21 and 25 as shown.

Figure 10:
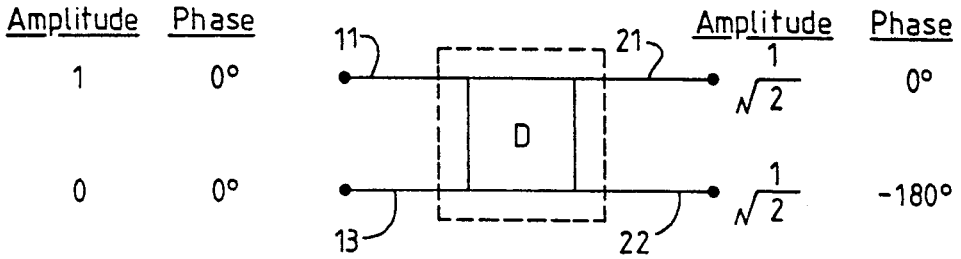
FIG. 10 is a diagram illustrating the operation of a 2×2 180° hybrid coupler of the "rat-race" type.

If desired the third layer of 90° hybrid couplers G, H and I may be replaced by 180° hybrids such as the "rat-race" hybrids shown in FIG. 10.

From FIG. 4 it will be noted that there are two cross-overs 30, 31 in the first group of transmission lines, and two cross-overs 40 and 41 in the second group of transmission lines, whereby this 6×6 configuration incurs a total of four cross-overs.

Figure 11:
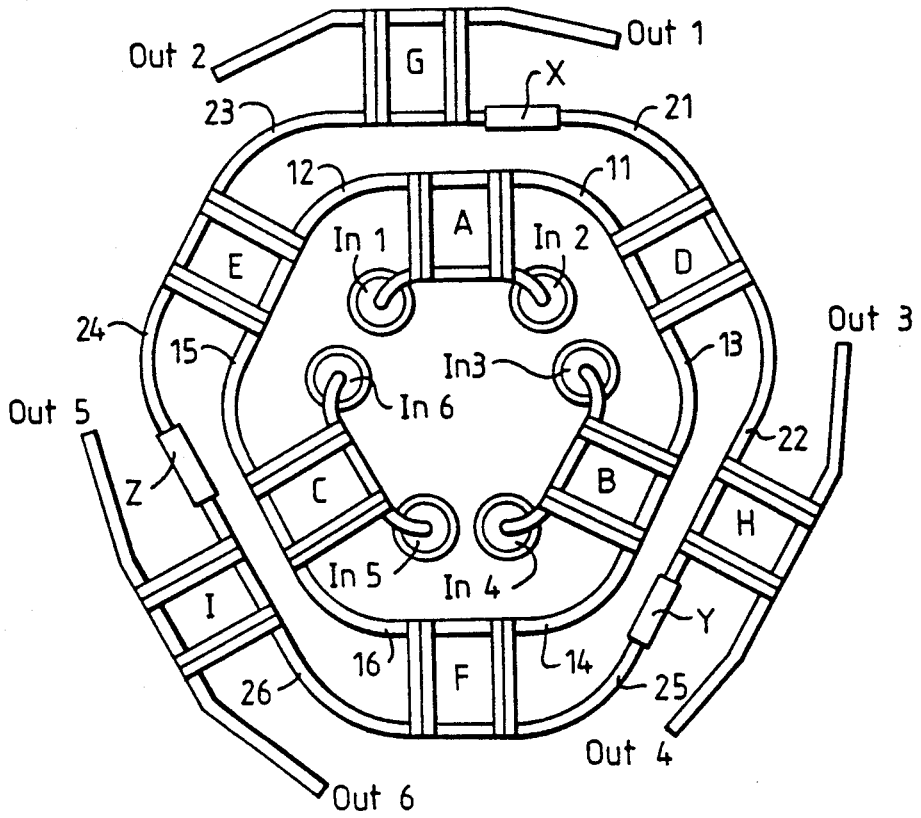
FIG. 11 illustrates a reorganization of the 6×6 coupler of FIGS. 4, 6 and 7 to avoid any cross-over connections.
Figure 12:
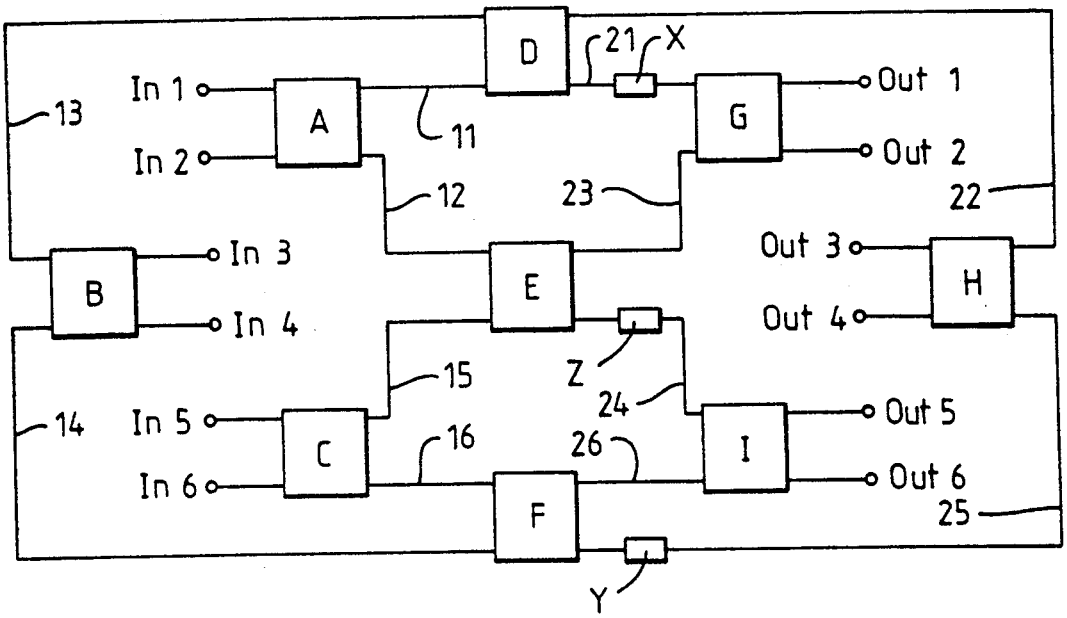
FIG. 12 is a diagram illustrating another reorganization of the 6×6 coupler of FIGS. 4, 6 and 7 to avoid any cross-over connections.

FIGS. 11 and 12 illustrate alternative reorganizations of the 6×6 multi-port coupler of FIG. 4 to eliminate all cross-overs. As the components and their connections are identical to FIG. 4, the same reference letters and numerals have been used to indicate equivalent components.

Referring specifically to FIG. 11, it will be noted that the first layer of hybrid couplers A, B and C are arranged within a transmission ring defining the first group of transmission lines 11, 12, 13, 14, 15 and 16. A second transmission ring is positioned outside the first transmission ring and defines the second group of transmission lines 21, 22, 23, 24, 25 and 26 together with the 90° phase shift devices X, Y and Z. The second layer of hybrid couplers D, E and F are interconnected between the two transmission rings whilst the third layer of hybrid couplers G, H and I are positioned outside the larger transmission ring. In addition to avoiding any cross-overs in the transmission lines, it will be noted that all six input ports are grouped together inside the smaller transmission ring, whilst all six output ports are grouped around the outside of the larger transmission ring. The two transmission rings can conveniently be formed of microstrip or strip-like elements and it should be noted that the lengths of the transmission lines between adjacent hybrid couplers should be chosen to preserve the correct phase relationships in each signal path. In practice, this can be achieved by making use of the fact that equal line lengths can be inserted into each path without perturbing the operation. If desired the arrangement illustrated in FIG. 11 could be turned inside out whereby the first set of hybrid couplers A, B and C together with their respective input ports would be arranged outside the larger transmission ring whilst the third set of hybrid couplers G, H and I and their respective outlet ports would be positioned within the smaller transmission ring, the phase shift devices X, Y and Z being appropriately relocated in the smaller transmission ring.

FIG. 12 illustrates an alternative reorganization of the three sets of hybrid coupling elements to avoid any cross-overs in their respective transmission lines. It will be noted that the six inlet ports are grouped together and the six outlet ports are also grouped together As the lengths of the transmission lines as illustrated are different, this realization would tend to be lossy and more prone to phase errors than that illustrated in FIG. 11 However, such problems could be mitigated by appropriately balancing the lengths of the transmission lines.

FIGS. 11 and 12 therefore teach how a 6×6 multi-port microwave coupler of the configuration taught by FIGS. 4 to 7 can be synthesized from 2×2 hybrid couplers without any cross-over connections, thereby enabling all of the first and second groups of transmission lines to lie in one plane to give a planar realization with all the attendant advantages already listed above in relation to the planar realization of the 4×4 multi-port coupler of FIG. 3. A 6×6 multi-port microwave coupler of the configuration taught by FIGS. 8 and 9 may be arranged in a similar manner to avoid any cross-over connections.

Whilst the invention has been specifically described with reference to a multi-port microwave coupler having n input ports and n output ports where $n=2^p\times3^q$ and $p=q=1$, it is believed that the teaching of FIGS. 4 to 7, and of FIGS. 8 to 10, may be usefully applied to higher orders of multi-port microwave couplers At the present time we have not studied the complete circuitry for such higher orders of multi-port coupler and have not established whether all cross-overs could be eliminated by utilizing the manipulations taught in FIGS. 11 and 12. However, it is quite clear that the total number of cross-overs could be greatly reduced by utilizing the teaching of the present invention.

I claim:

1. A multi-port microwave coupler having n input ports and n output ports, wherein $n=2^p\times3^q$ with p and q as whole numbers, comprising a plurality of hybrid couplers, each having two inputs and two outputs said hybrid couplers being arranged in three sets, the first set comprising n/2 90° hybrid 2×2 couplers each having a 3 db power reduction, the second set comprising n/2 90° hybrid 2×2 couplers each having a 1:2 or a 2:1 power split between their outputs, the third set comprising n/2 90° or 180° hybrid couplers, a first group of transmission lines interconnecting the outputs of the first set appropriately with the inputs of the second set, a second group of transmission lines interconnecting the outputs of the second set appropriately with the inputs of the third set, and phase shift means appropriately positioned in the second group of transmission lines.

2. A multi-port microwave coupler, according to claim 1, wherein the first hybrid coupler of the first set has its outputs respectively connected to inputs of the first and second hybrid couplers of the second set, the second hybrid coupler of the first set has its outputs respectively connected to inputs of the first and third hybrid couplers of the second set, the first hybrid coupler of the second set has one output connected through a 90° phase shift (constituting part of said phase shift means) to one input of the first hybrid coupler of the third set and its other output connected to an input of the second hybrid coupler of the third set, the second hybrid coupler of the second set has one output connected to the other input of the first hybrid coupler of the third set and its other output connected through a 90° phase shift (also constituting part of said phase shift means) to one input of the third hybrid coupler of the third set, and the remaining hybrid couplers are interconnected appropriately in similar manner.

3. A multi-port microwave coupler, according to claim 2, wherein the last hybrid coupler of the first set has its outputs respectively connected to inputs of the last and second hybrid couplers of the second set, and the last hybrid coupler of the second set has one of its outputs connected to an input of the last hybrid coupler of the third set and its other output connected through a 90° phase shift (also constituting part of said shift means) to an input of the second hybrid coupler of the third set.

4. A multi-port microwave coupler, according to claim 1, wherein $p=1$ and $q=1$, and there are no cross-over connections in the first or second groups of transmission lines.

5. A multi-port microwave coupler, according to claim 1, in which the first and second groups of transmission lines respectively comprise first and second transmission rings, the second set of hybrid couplers is arranged between the transmission rings with their inputs connected to the first transmission ring and their outputs connected to the second transmission ring.

6. A multi-port microwave coupler, according to claim 5, in which the first set of hybrid couplers is positioned on the opposite side of the first transmission ring to the second set of hybrid couplers and has its outputs connected to the first transmission ring, and the third set of hybrid couplers is positioned on the opposite side of the second transmission ring to the second set of hybrid couplers and has its inputs connected to the second transmission ring.

7. A multi-port microwave coupler, according to claim 6, in which the first and second transmission rings lie in the same plane.

8. A beam forming network for a multi-beam antenna incorporating a multi-port microwave coupler in accordance with claim 1.

* * * * *